US008146556B2

(12) United States Patent
Yoshikawa et al.

(10) Patent No.: US 8,146,556 B2
(45) Date of Patent: Apr. 3, 2012

(54) START CONTROL DEVICE OF INTERNAL COMBUSTION ENGINE

(75) Inventors: Satoshi Yoshikawa, Otsu (JP); Shinichi Murata, Okazaki (JP)

(73) Assignee: Mitsubishi Jidosha Kogyo Kabushiki Kaisha, Tokyo (JP)

( * ) Notice: Subject to any disclaimer, the term of this patent is extended or adjusted under 35 U.S.C. 154(b) by 390 days.

(21) Appl. No.: 12/475,161

(22) Filed: May 29, 2009

(65) Prior Publication Data

US 2010/0000478 A1 Jan. 7, 2010

(30) Foreign Application Priority Data

Jul. 2, 2008 (JP) ..... P.2008-173194
Jul. 2, 2008 (JP) ..... P.2008-173195

(51) Int. Cl.
*F02D 41/06* (2006.01)

(52) U.S. Cl. ..... 123/179.16

(58) Field of Classification Search ..... 123/179.16
See application file for complete search history.

(56) References Cited

U.S. PATENT DOCUMENTS

| | | | | |
|---|---|---|---|---|
| 6,382,188 | B2 * | 5/2002 | Hasegawa et al. | 123/179.16 |
| 7,664,594 | B2 * | 2/2010 | Kojima | 123/179.16 |
| 7,690,338 | B2 * | 4/2010 | Kawada | 123/90.15 |
| 7,726,270 | B2 * | 6/2010 | Miwa et al. | 123/179.3 |
| 2006/0096565 | A1 * | 5/2006 | Hattori et al. | 123/179.16 |
| 2008/0283005 | A1 * | 11/2008 | Kawada | 123/90.15 |
| 2009/0183706 | A1 * | 7/2009 | Miwa et al. | 123/179.16 |
| 2010/0108027 | A1 | 5/2010 | Nakamura et al. | |
| 2010/0204907 | A1 * | 8/2010 | Nakatani et al. | 701/108 |
| 2010/0282216 | A1 * | 11/2010 | Hisaminato et al. | 123/90.15 |
| 2010/0294245 | A1 * | 11/2010 | Yoshioka et al. | 123/90.15 |

FOREIGN PATENT DOCUMENTS

| | | | |
|---|---|---|---|
| JP | 2000-154753 | A | 6/2000 |
| JP | 2002-161768 | A | 6/2002 |
| JP | 2002-276446 | A | 9/2002 |
| JP | 2006-138299 | A | 6/2006 |
| JP | 2006-170163 | A | 6/2006 |
| JP | 2006-291939 | A | 10/2006 |
| JP | 2006-291940 | A | 10/2006 |
| JP | 2006-342677 | A | 12/2006 |
| JP | 2006-348774 | A | 12/2006 |
| JP | 2007-198308 | A | 8/2007 |
| JP | 2007-198367 | A | 8/2007 |
| JP | 2008-111375 | A | 5/2008 |

OTHER PUBLICATIONS

Japanese Office Action issued in Japanese Patent Application No. 2008-173195 on Sep. 21, 2011.
German Office Action issued in German Patent Application No. 10 2009 023 413.6 on Jun. 30, 2011.

* cited by examiner

*Primary Examiner* — Stephen K Cronin
*Assistant Examiner* — Arnold Castro
(74) *Attorney, Agent, or Firm* — Birch, Stewart, Kolasch & Birch, LLP

(57) ABSTRACT

A start control device of an internal combustion engine, the start control device includes: a starting unit, which cranks the internal combustion engine to start the internal combustion engine while opening and closing an intake valve; a variable valve mechanism, which can change a closing timing of the intake valve; and a control unit, which controls the variable valve mechanism so as to advance the closing timing of the intake valve while the starting unit cranks.

8 Claims, 9 Drawing Sheets

INTAKE TEMPERATURE SENSOR
COOLANT TEMPERATURE SENSOR
FUEL TEMPERATURE SENSOR
ECU
FUEL PROPERTIES DETECTING FUNCTION
VALVE OPENING AND CLOSING TIMING SETTING FUNCTION FOR STARTING
TIMING ADJUSTING FUNCTION
DEGREE VARIABLE FUNCTION
INFORMATION NECESSARY FOR DRIVING OF ENGINE
PUSH START SWITCH
START REQUEST SIGNAL
※1
※2
※3
M
70
71
72
65
61
62
63
64
73
66
60
41
25
35
43
40
42
31b
53
30
34
50
26
51
52
31a
32
31
20
15
21
22
23
3
13
18
17
14
12
11
19
2
1
6
4
7
9
8
67

START CONTROL DEVICE OF INTERNAL COMBUSTION ENGINE

BACKGROUND OF THE INVENTION

1. Field of the Invention

The present invention relates to a start control device of an internal combustion engine which performs starting by cranking in response to a start request.

2. Description of the Related Art

A reciprocating engine (internal combustion engine) to be installed in an automobile (vehicle) is started by cranking an engine when a starter is actuated in response to a start request issued by an operation on a start switch such as an ignition switch or a push switch.

Normally, in an engine, to reduce a load on starting, by setting a valve closing timing of an intake valve to a timing separated toward the top dead center apart from the bottom dead center of a compression stroke, an effective compression ratio is lowered and the load is reduced.

Recently, this valve closing timing of the intake valve is set by using a variable valve mechanism which changes the opening and closing timings of the intake valve.

Starting performance of an engine at an extremely low ambient temperature is demanded. Recently, additionally, starting performance in the case where, instead of a normal fuel such as gasoline, a fuel with different fuel properties such as an alcohol mixed fuel (mixed fuel) being hard to ignite is used has been demanded.

However, the alcohol mixed fuel is harder to vaporize than a normal fuel (gasoline). Therefore, with a related-art setting of the closing valve timing of the intake valve, an engine is hard to start. In particular, a fuel mixture ratio of the alcohol mixed fuel changes each time of fueling, so that the poor starting performance is also varied.

Therefore, starting performance of an engine adaptable to not only a normal fuel but also alcohol mixed fuels (0 to 100%) has been demanded.

Therefore, as disclosed in JP-A-2007-198308, a concentration sensor is provided inside a fuel tank of an automobile (vehicle) and a variable valve mechanism which changes a closing timing of an intake valve is adopted, and when starting an engine, the valve closing timing of the intake valve is changed (advanced) to a target valve closing timing on the bottom dead center side by the variable valve mechanism according to a fuel mixture ratio obtained from an alcohol concentration in the fuel in the tank detected from the concentration sensor. This is a technique of starting an engine by cranking upon making an environment with a higher internal cylinder temperature (by increasing an actual compression ratio of the cylinder), that is, an environment in which the fuel easily burns inside the cylinder by changing the valve closing timing of the intake valve.

According to this technique, the closing timing of the intake valve is advanced, the actual compression ratio of the cylinder increases, and the internal cylinder temperature rises, so that the fuel easily ignites.

However, the alcohol concentration in the fuel tank changes each time of fueling of the alcohol fuel. Further, in many cases, the fuel in the fuel line from the fuel tank to the engine, to be used for starting the engine in actuality has a different fuel mixture ratio from that at the time of fueling, and when starting the engine, the fuel mixture ratio of the alcohol mixed fuel when it is injected into the cylinder is unknown.

According to the technique described in JP-A-2007-198308, while this fuel mixture ratio is unknown, the valve closing timing of the intake valve is advanced to the valve closing timing set according to the alcohol concentration in the fuel tank, so that the engine starting performance inevitably becomes easily unreliable. Further, according to the technique described in JP-A-2007-198308, cranking is performed after the valve closing timing of the intake valve is changed, so that the load on starting is great, and the original measure for reducing the load is lost. In addition, according to the technique described in JP-A-2007-198308, a sensor for detecting a fuel mixture ratio of the alcohol mixed fuel, such as detecting the alcohol concentration, is needed separately, and this increases the cost burden in addition to the unreliability.

SUMMARY OF THE INVENTION

It is therefore an object of the present invention to provide a start control device of an internal combustion engine which can improve starting performance even when a mixed fuel is used by easy control which does not need a sensor.

It is another object of the invention to provide a start control device of an internal combustion engine which can reliably perform starting even when a fuel with fuel properties hard to ignite is used.

In order to achieve the above objects, according to the invention, there is provided a start control device of an internal combustion engine, the start control device comprising:

a starting unit, which cranks the internal combustion engine to start the internal combustion engine while opening and closing an intake valve;

a variable valve mechanism, which can change a closing timing of the intake valve; and a control unit, which controls the variable valve mechanism so as to advance the closing timing of the intake valve while the starting unit cranks.

The control unit may set a threshold value for determining whether the control unit controls the variable valve mechanism so as to advance the closing timing of the intake valve while the starting unit cranks. When a length of a time period in which the starting unit cranks exceeds the threshold value, the control unit may control the variable valve mechanism so as to advance the closing timing of the intake valve.

The closing timing of the intake valve may be advanced in a phased manner in increments of an amount.

The variable valve mechanism may change the closing timing of the intake valve while keeping an opening timing of the intake valve substantially constant.

The start control device may further include: a detecting unit, which detects properties of a fuel to be used for the internal combustion engine; and a setting unit, which sets a temporary closing timing for starting, based on the properties of the fuel detected by the detecting unit. The control unit may control the variable valve mechanism so as to advance the closing timing of the intake valve based on the temporary closing timing for starting while the starting unit cranks.

The detecting unit may detect the properties of the fuel during driving of the internal combustion engine. The setting unit may set a temporary closing timing for starting, based on the properties of the fuel detected by the detecting unit, during driving of the internal combustion engine. The control unit may control the variable valve mechanism to change the closing timing of the intake valve to the temporary closing timing for starting, when the internal combustion engine is stopped. The control unit may have a threshold value for determining whether the control unit controls the variable valve mechanism so as to advance the closing timing of the intake valve while the starting unit cranks. After the internal combustion engine is stopped, the closing timing of the intake valve may be set to the temporary closing timing for starting and the closing timing of the intake valve may be advanced from the temporary closing timing for starting when a length of a time period in which the starting unit cranks exceeds the threshold value.

The detecting unit may detect the properties of the fuel during driving of the internal combustion engine. The setting unit may set a temporary closing timing for starting, based on the properties of the fuel detected by the detecting unit, during driving of the internal combustion engine. The control unit may have a threshold value for determining whether the control unit controls the variable valve mechanism so as to advance the closing timing of the intake valve while the starting unit cranks. When a length of a time period in which the starting unit cranks exceeds the threshold value, the closing timing of the intake valve may be set to the temporary closing timing for starting and the closing timing of the intake valve may be advanced from the temporary closing timing for starting.

The start control device may further include: a situation detecting unit, which detects a situation of the internal combustion engine relating to ignition of the fuel. The control unit may change degree of advance of the closing timing of the intake valve in accordance with the properties of the fuel and the situation of the internal combustion engine.

DETAIL DESCRIPTION OF THE INVENTION

Hereinafter, the present invention will be described based on a first embodiment shown in FIG. 1 to FIG. 4.

Figure 1:
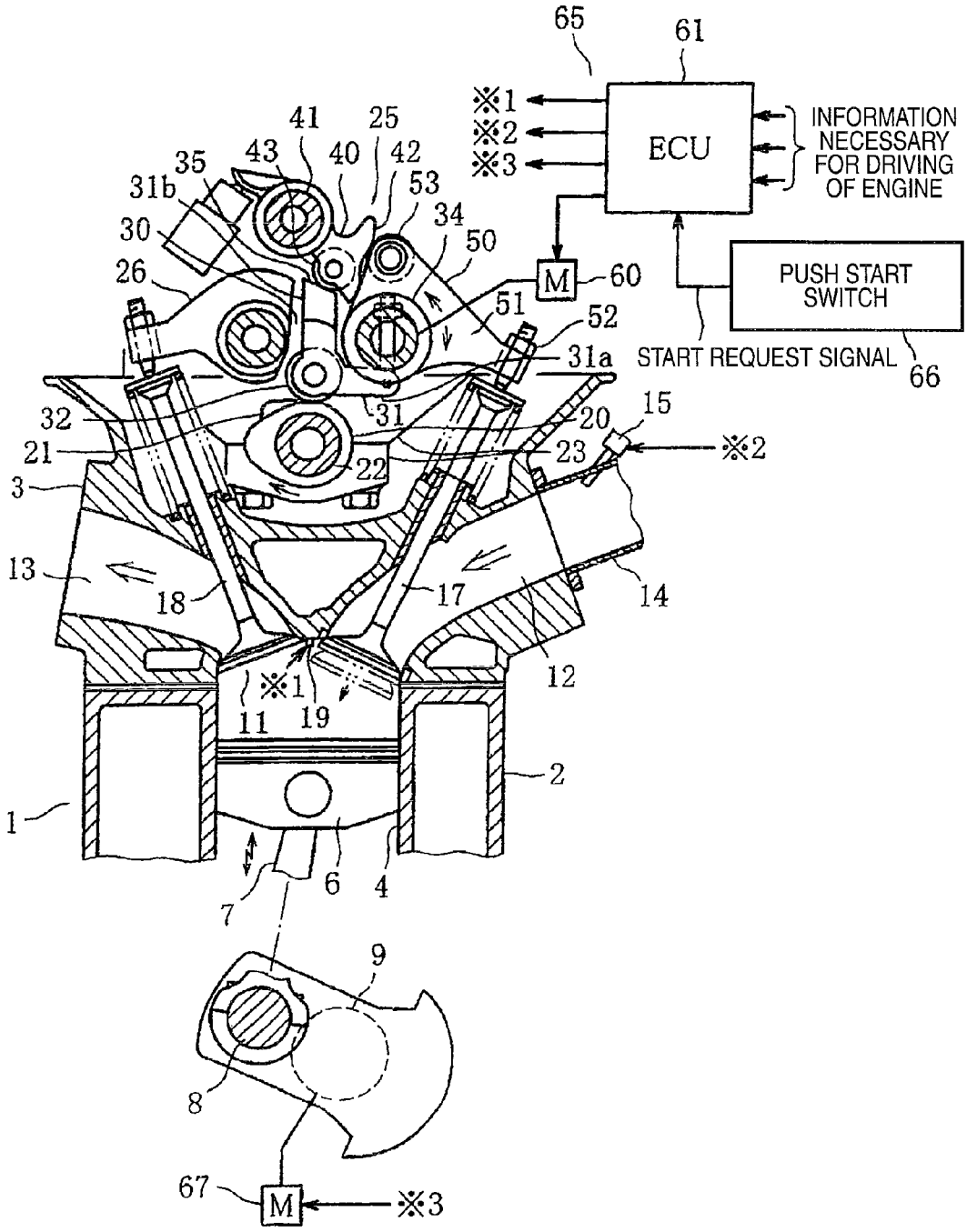
FIG. 1 is a view showing a control system of a start control device of a first embodiment of the present invention, together with a part of a cylinder head.

FIG. 1 schematically shows an internal combustion engine, such as a part of a reciprocating SOHC engine 1 for which an alcohol mixed fuel (mixed fuel) can be used, and a control system of the same engine 1.

First, describing the engine 1, in FIG. 1, the reference numeral 2 denotes a cylinder block, and the reference numeral 3 denotes a cylinder head mounted on the upper part of the cylinder block 2. In the cylinder block 1 of these, a cylinder 4 (only partially shown) is formed. Inside the cylinder 4, a piston 6 is housed so as to reciprocate. This piston 6 is joined to a crank shaft 9 provided on the lower part of the cylinder block 2 via a con rod 7 and a crank pin 8.

In the lower surface of the cylinder head 2, a combustion chamber 11 is formed. On both sides of the combustion chamber 11, an intake port 12 and an exhaust port 13 are formed. An intake manifold 14 connected to the intake port 12 is provided with a fuel injection valve 15 for injecting a fuel. The intake port 12 is provided with an intake valve 17, and the exhaust port 13 is provided with an exhaust valve 18. At the center of the combustion chamber 11, an ignition plug 19 is provided. On the upper part of the cylinder head 2, a camshaft 22 having both of an intake cam 20 and an exhaust cam 21 is provided rotatably via a holding member 23. The camshaft 22 is driven by a shaft output transmitted from the crank shaft 9.

Among the valves, to the intake valve 17, a variable valve mechanism 25 which changes a closing timing of the intake valve 17 is fitted. To the exhaust valve 18, a rocker arm 26 which drives and opens and closes the exhaust valve 18 at predetermined timings following normal primary valve characteristics, that is, cam displacement of the exhaust cam 21 is fitted.

Here, the variable valve mechanism 25 will be described. This mechanism 25 uses a structure (continuous lift variable valve mechanism) which continuously changes both of the valve lift and the opening and closing timings by combining a center rocker arm 30 disposed just above the intake cam 17, a swing cam 40 disposed just above the same center rocker arm 30, and an intake rocker arm 50 disposed on the intake valve 17 side adjacent to the swing cam 40.

In other words, the center rocker arm 30 is a component which moves up and down in response to displacement of the intake cam 20. In detail, the center rocker arm 30 includes an arm portion 31 having, for example, an L shape, and a slide roller 32 provided at the middle of the arm portion 31, and between these components, the slide roller 32 is in roll contact with the cam surface of the intake cam 20. An arm end portion 31*a* extending horizontally of the arm portion 31 is supported on an outer peripheral portion of a control shaft 34 supported rotatably on the intake valve 17 side of the cylinder head 2. Accordingly, the cam displacement of the intake cam 20 is transmitted to a swing cam 40 on the upper side by the slide roller 32, and further, swing displacement of the arm portion 31 around the end of the arm end portion 31*a* as a fulcrum. When the center control shaft 34 is turned and displaced, the center rocker arm 30 is displaced in directions crossing the axial center of the camshaft 22 (timing advance and timing delay directions) while changing the roll contact position with the intake cam 20.

The swing arm 40 has one end portion projecting toward the rocker arm 50 side and the other end portion on the opposite side supported on the support shaft 41 provided on the cylinder head 2 so as to turn. On the end face of the one end portion, a cam surface 42 which pushes and moves the rocker arm 50 is formed. On the lower part, a slide roller 43 is provided which comes into roll contact with the slope 35 formed on the end of the arm end portion 31*b* extending upward of the center rocker arm 30. Accordingly, the swing arm 40 swings around a support shaft 41 as a fulcrum when the center rocker arm 30 is driven. When the roll contact position of the center rocker arm 30 with the intake cam 20 is changed by turning displacement of the control shaft 34, the posture of the swing cam 40 changes (tilts).

The rocker arm 50 includes an arm member 51 which is turned and displaced by using the control shaft 34 as a rocker shaft. One end portion of the arm member 51 has an adjust screw portion 52 which pushes and moves the end of the intake valve 17, and the other end portion of the arm member has a needle roller 53 which comes into roll contact with the cam surface 42 of the swing arm 40. Accordingly, when the swing arm 40 swings, the needle roller 53 is pushed by the cam surface 42 or returns. Accordingly, the rocker arm 50 swings around the control shaft 34 as a fulcrum to open and close the intake valve 27.

Here, the cam surface 42 is formed so that the upper portion side is a base circle section corresponding to a base circle of the intake cam 20, and the lower portion side is a lift section continued to the base circle section, and when the slide roller 32 of the center rocker arm 30 is displaced in the timing advance direction or the timing delay direction of the intake cam 20 by turning displacement of the control shaft 34, the posture of the swing cam 40 changes and the region of the cam surface 42 on which the needle roller 53 rolls changes, and the ratio of the base section in which the needle roller 53 swings to the lift section changes. According to this change in ratio of the base section to the lift section with a phase change in the timing advance direction and a phase change in the timing delay direction, the valve lift amount of the intake valve 17 is continuously changed from low lift according to the top cam profile of the intake cam 20 to high lift according to the entire cam profile from the top to the basal end portion of the intake cam 20. Concurrently, the opening and closing timings of the intake valve 17 are changed so that the valve closing timing is more greatly changed than the valve opening timing.

Figure 2:
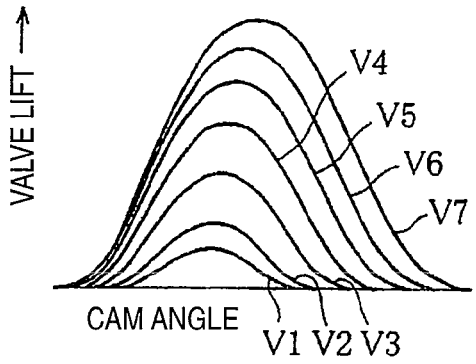
FIG. 2 is a diagrammatic view for describing characteristics of a variable valve mechanism installed in an engine.

In other words, the valve lift amount of the intake valve 17 is continuously changed from the low lift V1 to the high lift V7 by the variable valve mechanism 25 as shown in FIG. 2. Along with this, the valve closing timing is continuously changed while the valve opening timing is kept substantially constant.

A driver such as an electric motor 60 which drives the control shaft 34 is connected to a controller such as an ECU 61 (for example, consisting of a microcomputer). The ECU 61 is also connected to the fuel injection valve 15 and the ignition plug 19, etc. In the ECU 61, information (map, etc.) necessary for driving the engine 1, such as an ignition timing, a fuel injection amount, a fuel injection timing and an intake valve control amount according to the driving state of the engine are set in advance, and according to the driving state (for example, the vehicle speed, the number of engine rotations, and the accelerator opening, etc.) of the engine 1 entered from the ECU 61, the ignition timing, the fuel injection amount, the fuel injection timing, and the valve lift and the opening and closing timings of the intake valve 17 are controlled.

The engine 1 is provided with a start control device 65 including the ECU 61, the variable valve mechanism 25, and a starter which drives and rotates the crank shaft, such as an electric motor 67. The start control device 65 cranks the engine 1 by actuating the electric motor 67 when a start request signal is output in response to a turning-ON operation on a start switch such as a push start switch 66 connected to the ECU 61, and starts the engine with an ignition timing, a fuel injection amount, an injection timing, and normal opening and closing timings for starting (intake valve) suitable for starting.

This start control device 65 performs control to promote the starting performance of the engine 1 as well as the above-described control (engine control). As such control, control for realizing high starting performance is adopted in the case where a mixed fuel hard to ignite such as an alcohol mixed fuel is used for the engine 1 or in the case where the engine 1 is used in an environment with an extremely low temperature.

In this control, during cranking for starting the engine, the closing timing of the intake valve 17 is advanced by the variable valve mechanism 25.

In detail, a threshold value for determining whether the time is the timing of advancing the valve closing timing of the intake valve 17 during cranking is set in the ECU 61. This is set as, for example, a predetermined time value t, and it is determined whether, for example, the length of the cranking period has exceeded the predetermined time value t.

Here, as the predetermined time value t, a time value when the fuel is ignited and the engine 1 gets to start in the case where a normal fuel (for example, gasoline) is used, is used, and it is determined whether the fuel currently injected from the fuel injection valve 15 is harder to ignite than normal fuel. Therefore, the threshold value is not limited to the length of the cranking period, and the number of burning cycles of the engine and a value of change of cranking rotation (angular velocity obtained by a crank angle sensor) which brings about the same result may also be used.

Figure 3:
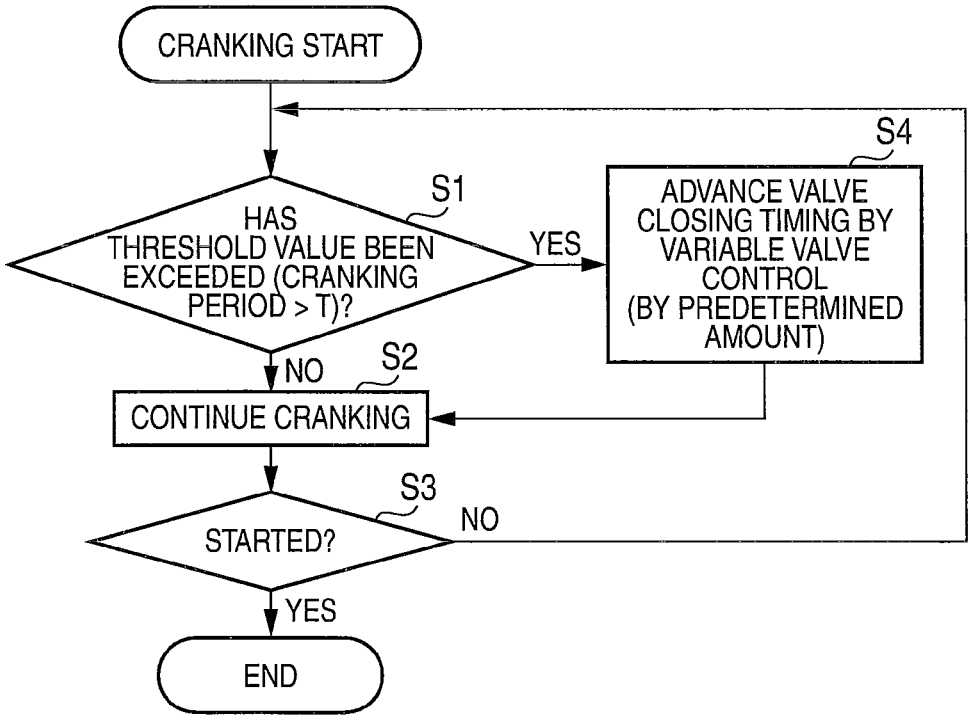
FIG. 3 is a flowchart for describing control of the start control device.
Figure 4:
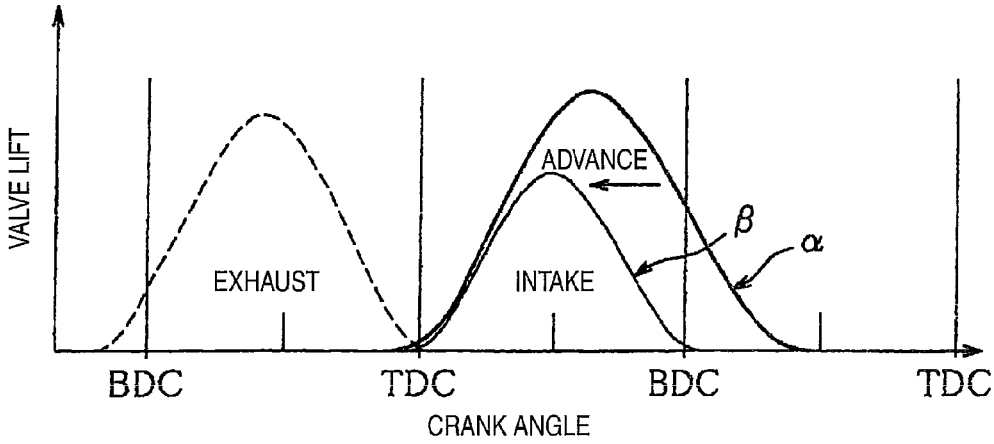
FIG. 4 is a view for describing timing advance of an intake valve during cranking when the engine starts.

In the ECU 16, control for advancing the closing timing of the intake valve 17 by actuating the electric motor 60 of the variable valve mechanism 25 when the length of the cranking period exceeds the threshold value, that is, the predetermined time value t herein is set. In detail, control for advancing the closing timing of the intake valve 17 in a phased manner in increments of a predetermined amount is set. By this control, during cranking, until the engine 1 is started, the closing timing of the intake valve 17 is gradually advanced to increase the actual compression ratio of the cylinder in a phased manner. In other words, even when a fuel hard to ignite is used or even in an environment in which a fuel is hard to ignite, the fuel can be easily ignited. FIG. 3 shows a flowchart of this control.

Next, a situation of starting of the engine 1 will be described with reference to this flowchart.

Now, it is assumed that, for example, the push start switch 66 has been turned ON and a start request signal has been output. At this time, the opening and closing timings of the intake valve 17 are set suitably for engine starting with a normal fuel (the valve closing timing is greatly separated toward the top dead center (TDC) from the bottom dead center (BDC) of the compression stroke (see the line $\alpha$ in FIG. 4).

From this state, the ECU 61 actuates the fuel injection valve 15, the ignition plug 19, and the electric motor 67 to crank the engine 1. Then, at the beginning of cranking, like normal starting, the intake valve 17 opens and closes according to the lift curve shown by the thick line $\alpha$ in FIG. 4, that is, opens and closes by setting the end greatly separated toward the top dead center from the bottom dead center of the compression stroke as a valve closing timing. The exhaust valve 19 opens and closes according to the lift curve of the exhaust cam 20 shown by the dashed line in FIG. 4.

Here, as shown in Step S1, the ECU 61 determines whether the length of this cranking period exceeds the threshold value. As the threshold value, a time to be taken for starting the engine by using a normal fuel (gasoline) is used. When a normal fuel is used in a normal environment, the process advances to Step S2 and Step S3 in order, and the engine 1 starts by only cranking within the predetermined time value T set to this time.

At this time, it is assumed that a fuel to be used for the engine 1 is not a normal fuel but a mixed fuel such as an alcohol mixed fuel whose fuel mixture ratio is hard to identify. Additionally, it is assumed that the engine is in an environment with an extremely low temperature (ignition is difficult). In this case, the fuel is not sufficiently vaporized in the cylinder, so that the engine does not get to start.

In such a situation where the ignition is difficult, the cranking period of the engine 1 becomes longer and exceeds the predetermined time value T. Then, the ECU 61 determines that starting is impossible in the current situation, and follows the routine reaching Step S4 from Step S1.

Then, the ECU 61 advances the closing timing of the intake valve 17 by a predetermined amount by controlling the variable valve mechanism 25 by actuating the electric motor 60. In detail, as shown by the arrow in FIG. 4, the opening and closing characteristics of the intake valve 17 change so that the valve closing timing approaches the bottom dead center of the compression stroke by a predetermined amount although the valve opening timing is kept substantially constant. When the valve closing timing approaches the bottom dead center of the compression stroke, the actual compression ratio of the cylinder increases, and raises the temperature inside the cylinder. Accordingly, an environment realizing easier vaporization of the fuel is made inside the cylinder.

Due to this environment, vaporization of the mixed fuel hard to ignite is promoted, and the fuel changes into a complete explosion state from the first explosion. According to continuity of this complete explosion, the ECU 61 determines that the engine has started (Step S3), and ends the starting control.

On the other hand, even at the changed closing timing of the intake valve 17, unless starting is confirmed, the process returns to the routine which starts from Step S1. Then, the ECU 61 controls the variable valve mechanism 25 to advance the closing timing of the intake valve 17 by the predetermined amount again.

This timing advance is performed in a phased manner until the start of the engine is confirmed. In other words, at the later stage of the cranking period, unless the start of the engine is confirmed, the closing timing of the intake valve 17 is continuously advanced in a phased manner according to the lift curve of the thin line β shown in FIG. 4 until the closing timing approaches the bottom dead center of the compression stroke. During this time, the environment which makes the fuel easily vaporize inside the cylinder is continuously enhanced (temperature rise inside the cylinder: great).

Accordingly, at the later stage of the cranking period, even when a mixed fuel such as an alcohol mixed fuel which makes it difficult to start is used or even in an environment with an extremely low temperature, vaporization of the fuel is promoted and the engine 1 gets to start.

Therefore, the engine 1 can reliably start even with a fuel which makes it difficult to start or even in an environment with an extremely low temperature. In particular, the starting control is for a fuel to be supplied into the cylinder in actuality, so that even when the fuel mixture ratio of an alcohol mixed fuel changes, the engine 1 can be reliably started.

Therefore, the starting performance of the engine can be improved. This is preferable particularly when a mixed fuel whose fuel mixture ratio change is hard to grasp is used. In addition, the cranking period is prevented from being wastefully lengthened, so that the starting fuel can be reduced. Further, the starting control is easily performed by simply advancing the closing timing of the intake valve 17 during cranking until complete explosion of the fuel is confirmed. Additionally, when starting cranking, the valve closing timing of the intake valve 17 may be the same as it has been, so that the starting load is reduced, and there is no need to sacrifice the characteristics which realize easy starting. Further, a sensor is not required, so that the cost burden is also small. Further, at the beginning of the cranking period, even when the intake valve 17 is changed to the later closing side than in the past, the starting performance is secured, so that the Miller cycle according to the delayed closing of the intake valve 17 is made, and the fuel consumption of the engine can be reduced.

In particular, as the variable valve mechanism 25, when a mechanism which changes the valve closing timing of the intake valve 17 is changed while keeping the valve opening timing substantially constant is adopted, the actual compression ratio inside the cylinder can be effectively raised, so that the temperature inside the cylinder can be effectively raised, and high starting performance is realized for the engine.

As the starting control, control is adopted in which a threshold value for determining the valve closing timing is going to be advanced is set, and when the length of the cranking period exceeds the threshold value, the valve closing timing of the intake valve 17 is advanced, so that only when the timing must be advanced, the closing timing of the intake valve 17 can be advanced, and effective timing advance control can be performed. Further, by advancing the timing of the intake valve 17 in a phased manner, regardless of the fuel which makes it difficult to start or the environment with an extremely low temperature, the engine 1 can start more reliably.

Figure 5:
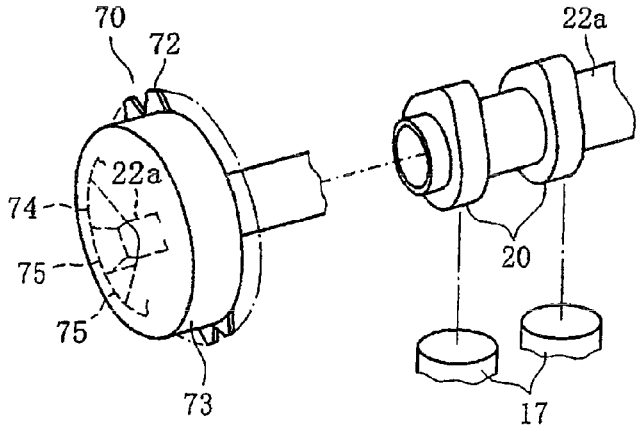
FIG. 5 is a perspective view describing a variable valve mechanism having a different form, as apart of a second embodiment of the present invention.
Figure 6:
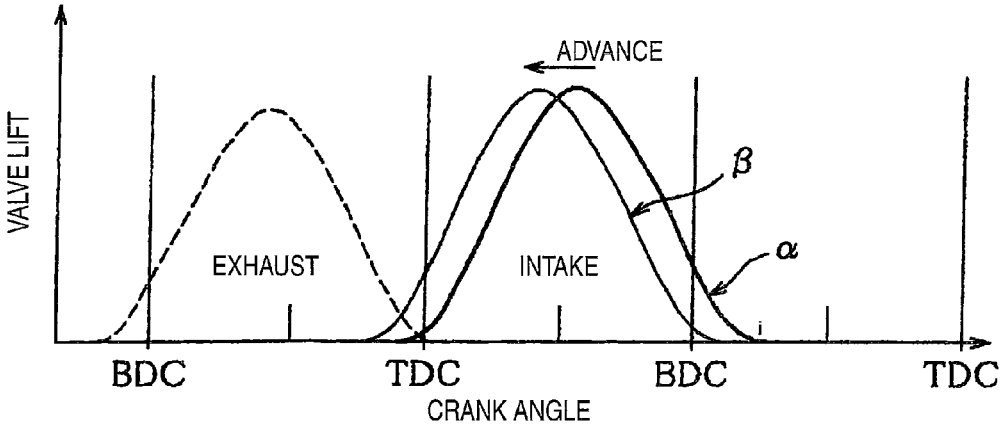
FIG. 6 is a view for describing timing advance of an intake valve during cranking of the engine by the same variable valve mechanism.

FIG. 5 and FIG. 6 show a second embodiment of the present invention.

In the present embodiment, as a variable valve mechanism, instead of a continuous lift variable valve mechanism which continuously changes both of the valve lift and the valve opening and closing timings as in the first embodiment, a continuous phase variable valve mechanism 70 which continuously changes the phase of the intake valve 8 is used (applied to a DOHC engine).

In other words, in this mechanism 70, an advance chamber 74 and a delay chamber 75 are provided inside, for example, a short cylinder-shaped housing 73 having an intake cam sprocket 72, and between these advance chamber 74 and the delay chamber 75, a vane connected to the intake camshaft 22*a* is provided, and by displacing the vane to the delay chamber 74 or the advance chamber 75 by supplying a hydraulic pressure, the phase of the intake cam 20 is delayed or advanced.

By using this continuous phase variable valve mechanism 70, as shown in FIG. 6, during cranking of the engine, by changing the phase of the intake valve 17 from the thick line α at the beginning of the cranking period to the thin line β at the later stage of the cranking period, the closing timing of the intake valve 17 may be advanced.

Figure 7:
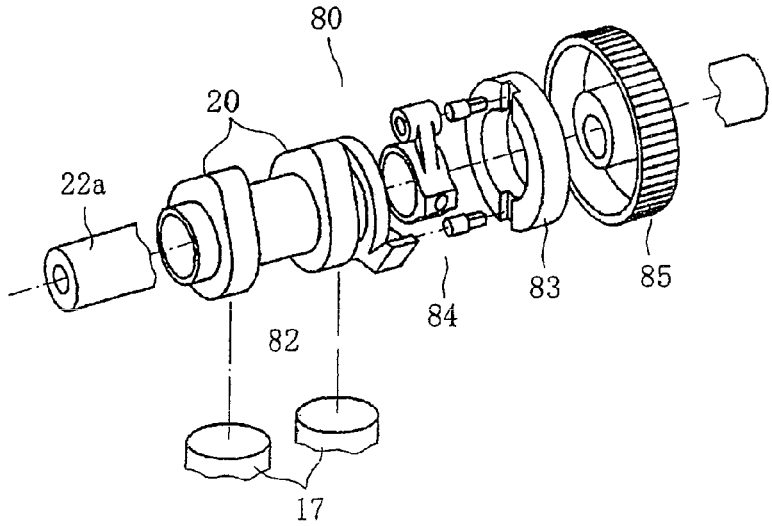
FIG. 7 is a perspective view describing a variable valve mechanism having a different form, as a part of a third embodiment of the present invention.
Figure 8:
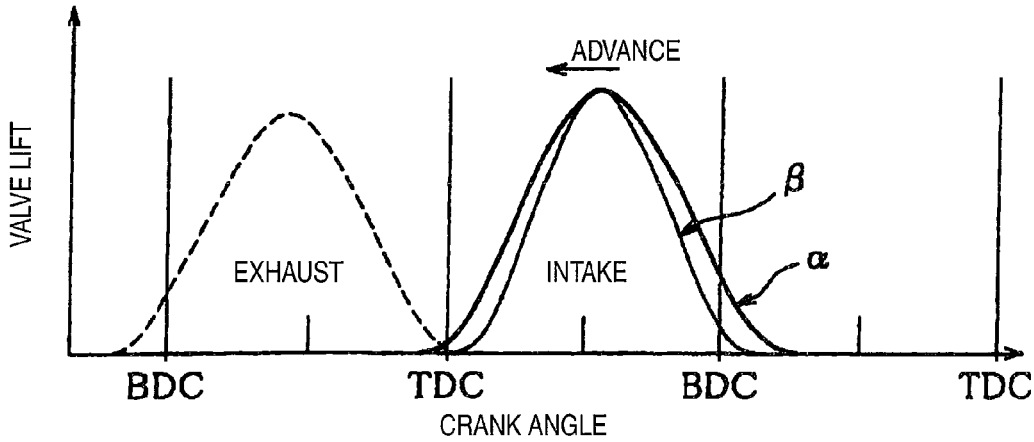
FIG. 8 is a view for describing timing advance of an intake valve during cranking of the engine by the same variable valve mechanism.

FIG. 7 and FIG. 8 show a third embodiment of the present invention.

In the present embodiment, as a variable valve mechanism, a continuous valve opening period variable valve mechanism 80 which continuously changes the valve opening period of the intake valve 17 is used (applied to an DOHC engine).

This mechanism 80 continuously changes the valve opening period of the intake valve 17 by changing the constant rotation of the intake camshaft 10 into inconstant speed rotation.

In other words, in this mechanism 80, a cam lobe 82 with an intake cam 20 is fitted rotatably onto the outer peripheral surface of an intake camshaft 22*a*. The rotation of the camshaft 22*a* is changed in speed with a predetermined period by an inconstant speed mechanism 84 using a harmonic ring 83 and transmitted to the cam lobe 82. Then, by controlling the eccentric phase of the harmonic ring 83 by a harmonic gear 85, the speed at which the intake cam 20 passes through the basal end portion of the intake valve 17 is continuously changed.

By using this continuous valve opening period variable valve mechanism 80, as shown in FIG. 8, during cranking of the engine, for example, by changing the valve opening period of the intake valve 17 from the thick line α at the beginning of the cranking period to the thin line β at the later stage of the cranking period, the closing timing of the intake valve 17 may be advanced.

According to the above-described embodiments, when starting the internal combustion engine, the closing timing of the intake valve is gradually continuously advanced from a normal valve closing timing until starting, so that inside the cylinder, a situation which makes the ignition easier (actual compression ratio: great) is obtained which can cope with even a fuel hard to ignite and a situation which makes the internal combustion engine difficult to start.

Therefore, even with an alcohol mixed fuel or even in an environment with an extremely low temperature, the engine can be reliably started. Further, an increase in load when starting the engine can also be reduced. This is suitable particularly for a mixed fuel whose fuel mixture ratio change is hard to grasp.

In addition, the starting performance can be secured by simply advancing the closing timing of the intake valve without requiring a sensor, and this is an easy control and the cost burden is small.

The valve closing timing of the intake valve can be advanced only when the timing must be advanced.

Further, the timing advance of the intake valve is performed in a phased manner in increments of a predetermined amount, so that the engine can start more reliably even with a fuel hard to ignite or even in an environment with an extremely low temperature.

The actual compression ratio inside the cylinder can be effectively increased, and the temperature inside the cylinder can be effectively raised.

Hereinafter, the present invention will be described with reference to a fourth embodiments shown in FIG. 9 to FIG. 11.

Figure 9:
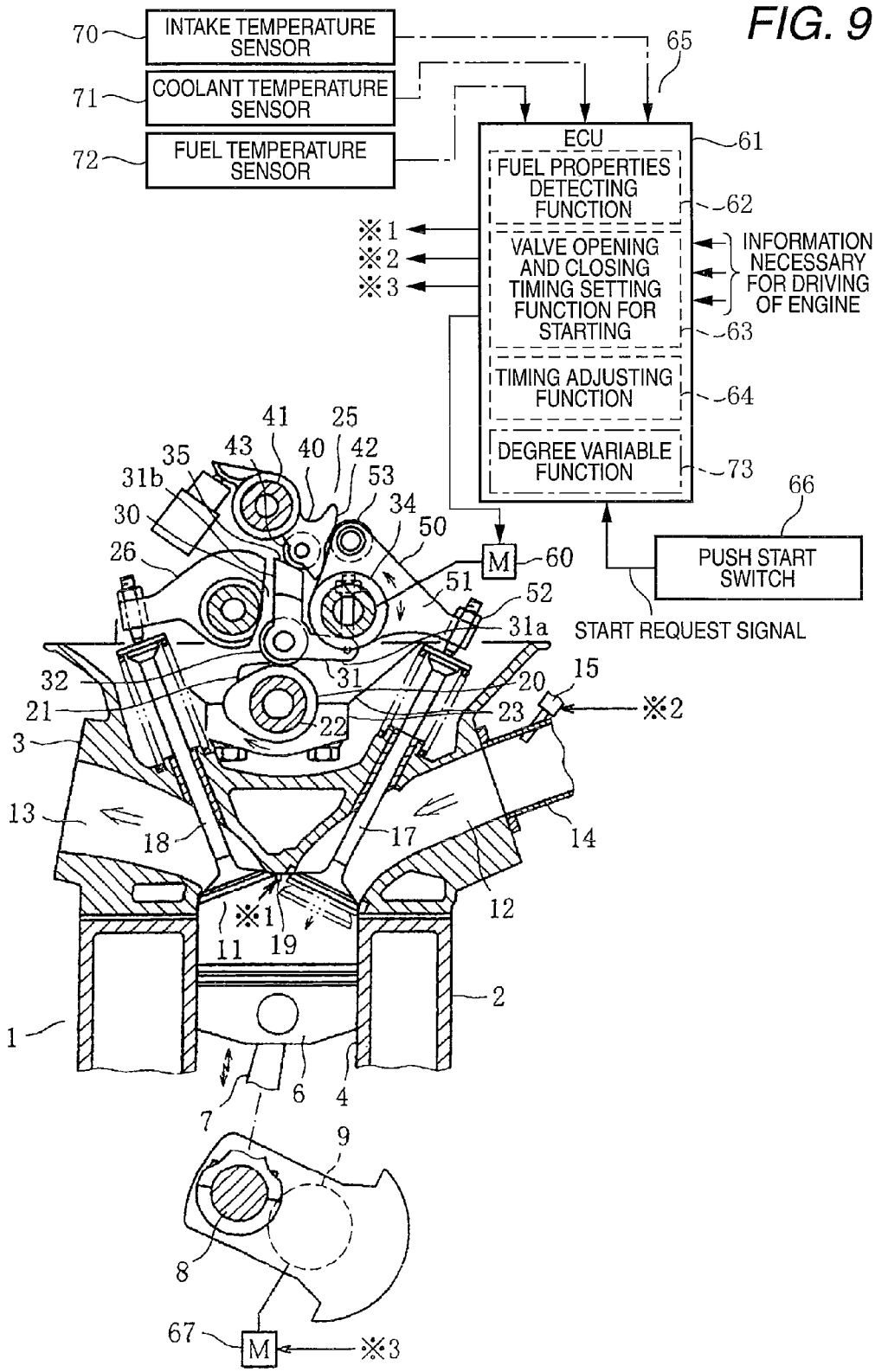
FIG. 9 is a view showing a control system of a start control device of a fourth embodiment of the present invention, together with a part of a cylinder head.

In FIG. 9, the same components as in the above-described embodiments are attached with the same reference numerals, and description thereof will be omitted.

As described above, the start control device 65 also performs control for promoting the starting performance of the engine 1, and as such control, control is adopted which brings about high starting performance even in a case where a mixed fuel such as an alcohol mixed fuel hard to ignite is used for the engine 1 or the engine 1 is used in an environment with an extremely low temperature. In this control, when starting the engine, during cranking, based on a valve closing timing suitable for the fuel properties, the closing timing of the intake valve 17 is advanced by the variable valve mechanism 25.

In this case, for example, a technique is used in which, when stopping the engine, upon adjusting the closing timing of the intake valve 17 to a temporary closing timing for starting suitable for the fuel properties, the engine 1 is stopped. Then, at the next start of the engine, the cranking is started from this temporary closing timing for starting, and when timing advance is requested, the valve closing timing of the intake valve 17 is advanced from the temporary closing timing for starting during cranking.

In detail, as components necessary for adjusting the valve closing timing of the intake valve 17 to the valve closing timing for starting, the following components are used.

That is, the ECU 61 is provided with a fuel property detecting function 62 as a detecting unit for detecting fuel properties. This function detects fuel properties of a fuel to be supplied into the cylinder from, for example, an ignition timing value during driving of the engine. For example, in the case of an alcohol mixed fuel, the higher the mixture ratio of the alcohol fuel, the harder it is to ignite, so that the ignition timing assumes a behavior to delay the ignition timing to be later than the normal ignition timing. The fuel property detecting function 62 indirectly detects fuel properties, for example, in the case of an alcohol mixed fuel, what alcohol concentration the fuel has from the ignition timing during driving. Further, the ECU 61 is provided with a valve opening and closing timing setting function 63 for starting which temporarily sets a valve closing timing for starting of the intake valve to be used when starting from the detected ignition timing. Further, the ECU 21 is provided with a timing adjusting function 64 for controlling the variable valve mechanism 24 so that the closing timing of the intake valve 17 is set to a temporary closing timing for starting when stopping the engine, and after temporary opening and closing timings of the intake valve 17 suitable for the fuel properties are set, the fuel cut or ignition cut is performed for the engine 1, and the engine stops.

Components necessary for advancing the valve closing timing from the valve closing timing for starting of the intake valve 17 are as follows.

That is, in the ECU 61, a threshold value for determining whether the valve closing timing of the intake valve 17 is going to be advanced in the cranking period for engine start is set. This is set as a predetermined time value T, and for example, the determination is made based on whether the length of the cranking period exceeds a certain predetermined time value t1.

Here, an average time value when the fuel is ignited and the engine 1 gets to start is used as the predetermined time value T, and is for determining whether the fuel injected from the current fuel injection valve 15 is hard to ignite. Therefore, the threshold value is not limited to the value of the cranking period, and the number of engine combustion cycles or the value of change of cranking rotation (angular velocity obtained by a crank angle sensor) which brings about the same effect can also be used as the threshold value.

In the ECU 61, control for advancing the closing timing of the intake valve 17 by actuating the electric motor 60 of the variable valve mechanism 25 during cranking when the cranking period exceeds the threshold value, that is, herein, when the length of the cranking period exceeds the predetermined time value T is set. For example, the closing timing of the intake valve 17 is advanced in a phased manner in increments of a predetermined amount. By this control, the valve closing timing of the intake valve 17 is gradually advanced from the temporary closing timing for starting during cranking until the engine 1 is started, and the actual compression ratio of the cylinder is gradually improved.

Figure 10:
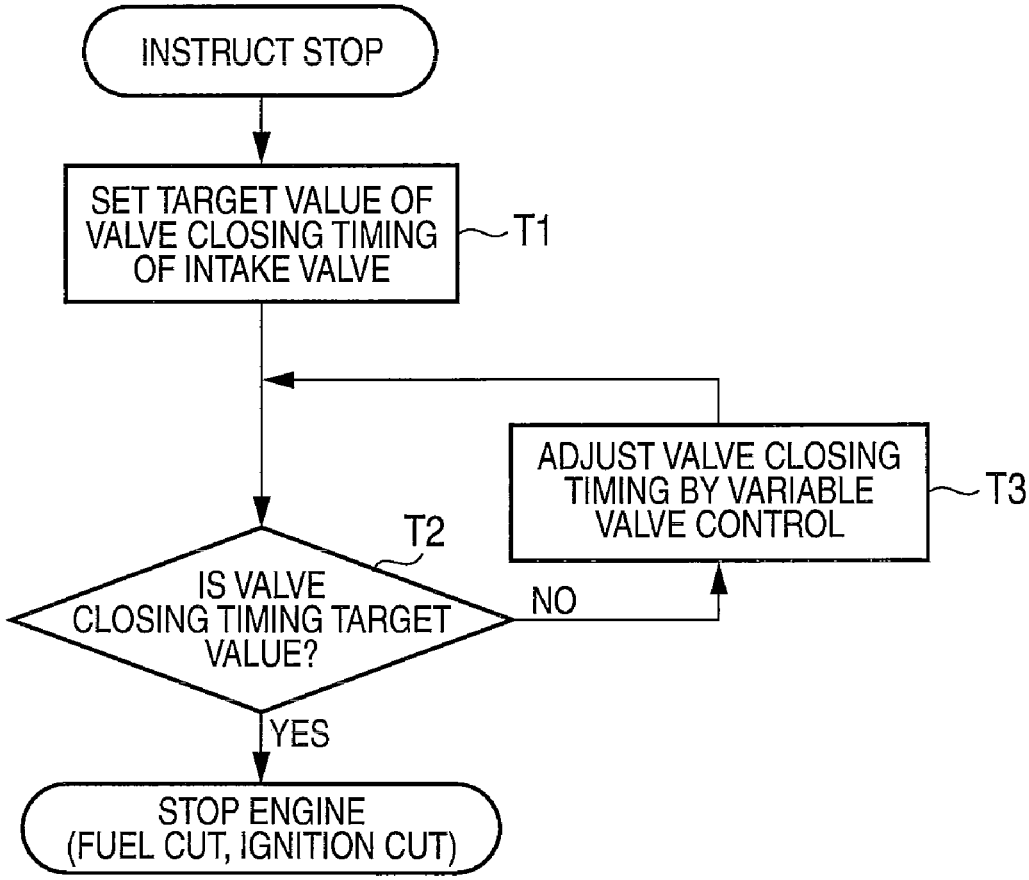
FIG. 10 is a flowchart for describing control relating to target value setting of an intake valve of the start control device.
Figure 11:
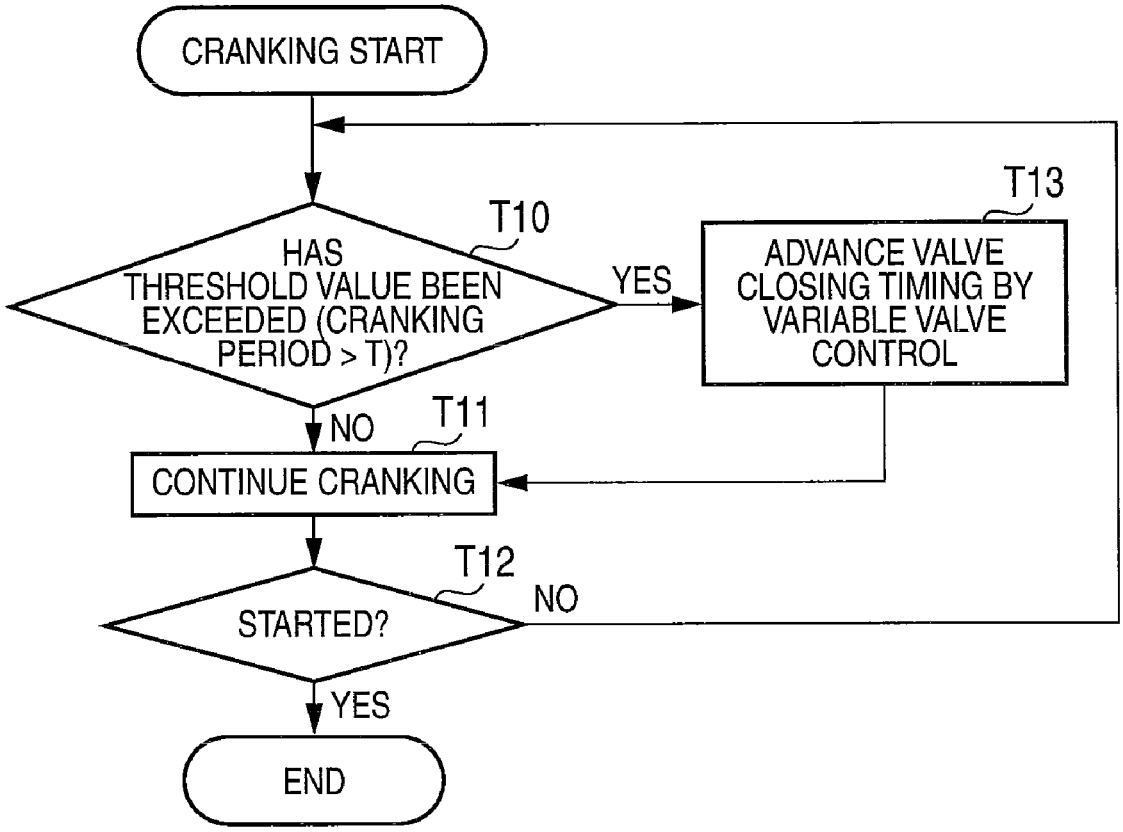
FIG. 11 is a flowchart for describing control relating to timing advance of an intake valve of the start control device.

FIG. 10 and FIG. 11 show flowcharts of this control. FIG. 11 shows control to be performed until the engine 1 stops, and FIG. 11 shows control to be performed until the engine 1 starts.

Describing the flowchart of FIG. 10, now it is assumed that, for stopping driving of the engine 1, the push start switch 66 has been turned OFF and a stop request signal has been output.

Then, first, the ECU 61 detects fuel properties as starting conditions of the current fuel such as a normal fuel or an alcohol mixed fuel from the values of the ignition timing, etc., of driving with the current fuel by using the fuel property detecting function 62. In the case of an alcohol mixed fuel, the mixture ratio and the alcohol concentration of the alcohol fuel are detected. Then, from the detected fuel properties, the ECU 61 temporarily determines a valve closing timing for starting by the valve opening and closing timing setting function 63 for starting, and sets it as a target value of the valve closing timing of the intake valve 17 as in Step T1. Subsequently, the process advances to Step T2, and the current valve closing timing of the intake valve 17 and the target value are compared. When the current closing timing of the intake valve 17 is not the target timing, the process advances to Step T3, and the ECU 61 adjusts the valve closing timing to the target value (valve closing timing for starting) by controlling the variable valve mechanism 25. Thereafter, the ECU 61 stops the fuel supply and stops ignition to stop the engine 1.

In other words, in response to the stop of the engine 1, the intake valve 17 is set to a valve closing timing which realizes easy ignition suitable for properties of the fuel in use in preparation for the next start of the engine.

On the other hand, after stopping the engine, as shown in the flowchart of FIG. 11, it is assumed that, to drive the automobile, the push start switch 66 has been turned ON and a start request signal has been output (cranking start).

Then, the ECU 61 actuates the fuel injection valve 15, the ignition plug 19, and the electric motor 67 to crank the engine 1. Accordingly, the intake valve 17 closes at the set valve closing timing for starting, and the exhaust valve 18 opens and closes at predetermined timings. $\alpha$ in FIG. 4 indicates a lift curve of the intake valve 17 in this case, and the dashed line indicates a lift curve of the exhaust valve 18.

Here, as shown in Step T10, the ECU 61 determines whether the length of this cranking period exceeds a threshold value. As the threshold value, for example, an average of the time to be taken for starting the engine is used.

At this time, it is assumed that the temporarily set valve closing timing for starting is suitable for the fuel in use, and the starting environment of the engine 1 is normal (not an environment with difficulty in ignition). The process advances to Step T11 and Step T12, and only in the cranking period within the predetermined time value T, the engine 1 starts.

Here, it is assumed that the fuel properties of the fuel to be used for the engine 1 change or the environment in which the engine 1 is located changes to an environment with difficulty in engine starting. This is, for example, in the case where the mixture ratio of the alcohol fuel in the alcohol mixed fuel changes due to fueling or the engine is located in an environment with difficulty in engine starting.

In such a case, the fuel is hard to ignite, so that the engine 1 does not get to start within the predetermined time value t.

If the fuel is hard to ignite, the cranking period of the engine 1 becomes longer and exceeds the predetermined time value T. The ECU 61 determines that the engine cannot be started in the current situation, and advances the process to Step T13 from Step T10.

Then, the ECU 61 controls the variable valve mechanism 25 by actuating the electric motor 60 to advance the current valve closing timing of the intake valve 17 (by a predetermined amount). In detail, based on the valve closing timing for starting, the valve closing timing of the intake valve 17 approaches the bottom dead center of the compression stroke while the valve opening timing is kept substantially constant as shown by the valve lift $\beta$ in FIG. 4.

The actual compression ratio inside the cylinder increases as the valve closing timing comes closer to the bottom dead center of the compression stroke, and raises the internal cylinder temperature, so that the fuel becomes easier to ignite according to promoted vaporization.

Then, when a complete explosion state continues from first explosion, the ECU 61 determines that the engine has started (Step T12), and ends the starting control.

On the other hand, even at the advanced valve closing timing of the intake valve 17, if the start of the engine is not confirmed, the process returns to the routine starting from Step T10 again, and the ECU 61 further advances the closing timing of the intake valve 17 (by a predetermined amount) by controlling the variable valve mechanism 25 again.

This advance is continued until the start of the engine 1 is confirmed. In other words, the advance is continued in a phased manner until the closing timing of the intake valve 17 reaches the bottom dead center (highest actual compression ratio) of the compression stroke.

Therefore, even with the fuel properties hard to ignite, even in an environment with an extremely low temperature which makes difficult the ignition, or even with the fuel properties changed, the engine 1 can be reliably started by advancing the valve closing timing of the intake valve 17 during cranking. Further, the valve closing timing of the intake valve 17 is advanced based on the valve closing timing for starting suitable for the fuel properties of the previous engine driving, so that the cranking period is prevented from being wastefully lengthened, and quick starting in a short time is possible. In addition, the closing timing of the intake valve 17 when starting the engine can be completely separated from that of normal driving of the engine 1, so that the Miller cycle can be made by delayed closing of the intake valve 17 in normal driving of the engine 1.

Additionally, control is adopted in which the closing timing of the intake valve 17 when stopping the engine is temporarily set to a valve closing timing for starting suitable for the current fuel properties, and at the next start of the engine, cranking is started from this valve closing timing for starting, and only when the ignition is difficult, the valve closing timing of the intake valve 17 is advanced, so that even in a state where the components of the engine have not been sufficiently lubricated with a lubricant and the friction is great as in the cold state, the engine 1 can be started by the smooth movement of the variable valve mechanism 25. In other words, after the lubricant is supplied to the components of the internal combustion engine by cranking and the friction is reduced, the variable valve mechanism 25 is actuated, so that the timing advance control of the intake valve 17 can be smoothly performed, and quick starting can be kept.

In particular, as the variable valve mechanism 25, a mechanism which changes the valve closing timing while keeping the valve opening timing of the intake valve 17 substantially constant, so that the actual compression ratio inside the cylinder can be effectively increased, and quicker starting of the engine is realized.

Figure 12:
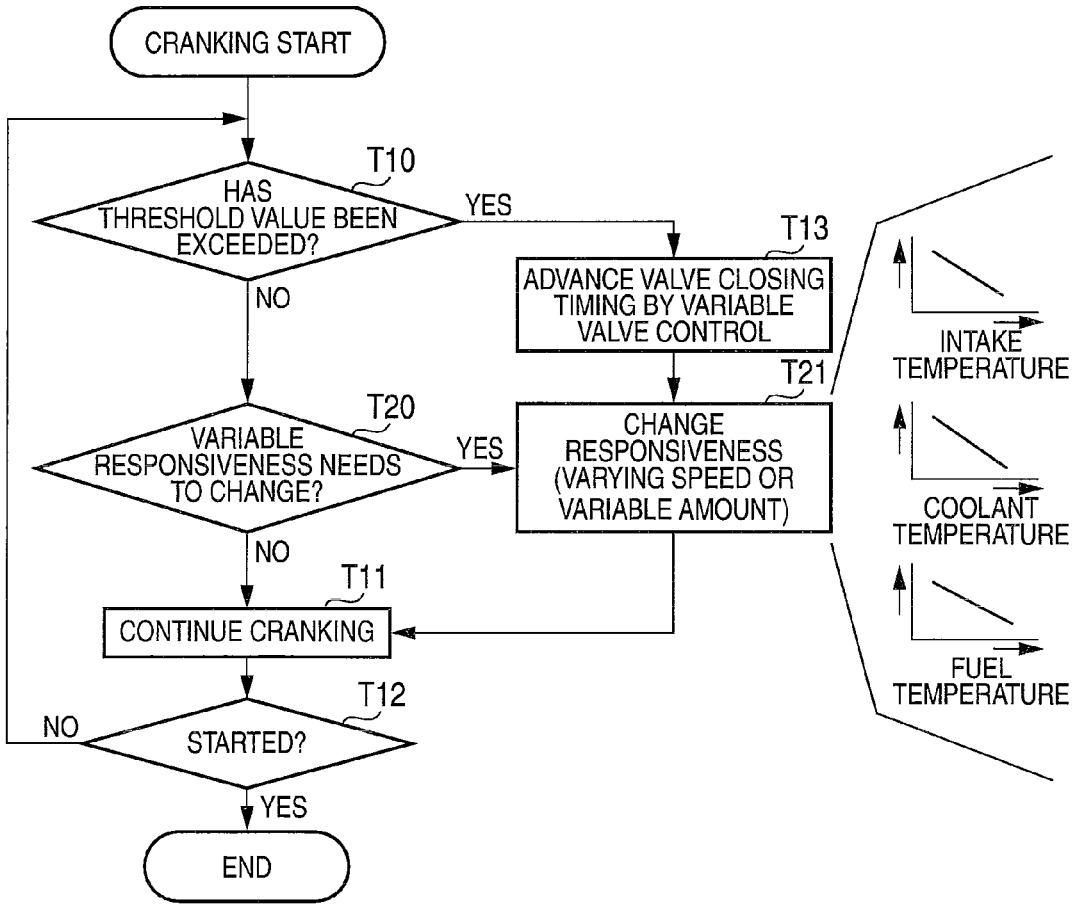
FIG. 12 is a flowchart describing control of a start control device as a part of a fifth embodiment of the present invention.

FIG. 12 shows a fifth embodiment of the present invention.

In the present embodiment, a technique for changing the degree of timing advance of the intake valve 17 is added to the fourth embodiment so that the internal combustion engine is more quickly started.

In detail, as shown by the alternate long and short dashed line in FIG. 9, the ECU 61 is provided with, as a situation detecting unit for detecting the situation of the engine 1 which makes difficult the ignition of the fuel, for example, an intake temperature sensor 70 which detects the intake temperature of the engine 1, a coolant temperature sensor 71 which detects a coolant temperature of the engine 71, and a fuel temperature sensor 72 which detects the fuel temperature, and information relating to ignition is entered. Further, the ECU 61 is provided with a function for storing information on the fuel properties of the previous engine driving (the proportion of heavy fuel and the mixture ratio of alcohol fuel, etc.). Further, the ECU 61 is provided with a degree variable function 73 for varying the degree of advance. The degree variable function 73 has a determination function for determining whether conditions relating to ignition for engine driving such as the intake temperature, the cooling temperature, and the fuel temperature are temperatures which make difficult ignition, and whether the conditions relating to the fuel properties of the previous engine driving (the proportion of heavy fuel and the mixture ratio of alcohol fuel, etc.) are hard to ignite. Further, the degree variable function 73 has a function for requesting a change in responsiveness of the intake valve 17 when it determines that ignition is difficult. Further, the degree variable function has a variable function which varies the degree of change of the valve closing timing of the intake valve 17 by using a predetermined map, for example, a map showing changes in the intake temperature, the coolant temperature, the fuel temperature, and other fuel properties shown in FIG. 12 in response to a responsiveness change request. This variable function is formed as a function for variation to, for example, a great advance or a quick advance according to the degree of ignition difficulty, and according to the degree of ignition difficulty in the conditions, the varying speed and the variable amount of timing advance of the intake valve 17 are changed. In other words, the responsiveness is changed.

In the flowchart of FIG. 12, Step T20 is provided between Step T10 and Step T11 of the flowchart of FIG. 11 of the fourth embodiment, and control for requesting a responsiveness change of the degree variable function 73 is performed at Step T20, and between Step T13 and Step T11, Step T21 is provided, and at Step T21, when the situation of the engine 1 has difficulty in ignition or the fuel properties are hard to ignite, the process advances to Step T21, and according to the map, the control for setting a high varying speed or a large variable amount of the intake valve 17 is performed.

Thus, by providing a control for changing the degree of timing advance of the intake valve 17, the engine can be more quickly started. In other words, as shown in the flowchart of FIG. 12, in the cranking period, when it is determined that the engine is in a situation with ignition difficulty at Step T20, the process advances to Step T21, and the varying speed and the variable amount of the variable valve mechanism 25 are changed to larger values (for example, advance step amount: large, advance speed: high) based on the predetermined map (variable degree map based on the intake temperature, the coolant temperature, the fuel temperature, and fuel properties) so that the valve closing timing of the intake valve 17 is advanced to a valve closing timing leading to starting in a time as short as possible. The variable valve mechanism 25 which is actuated over the threshold value performs the timing advance according to the changed values. In other words, by actuating the variable valve mechanism 25 in consideration of the ignition difficulty, the responsiveness of advance of the valve closing timing of the intake valve 17 is changed, and the engine 1 can be started most quickly in a short time.

Figure 13:
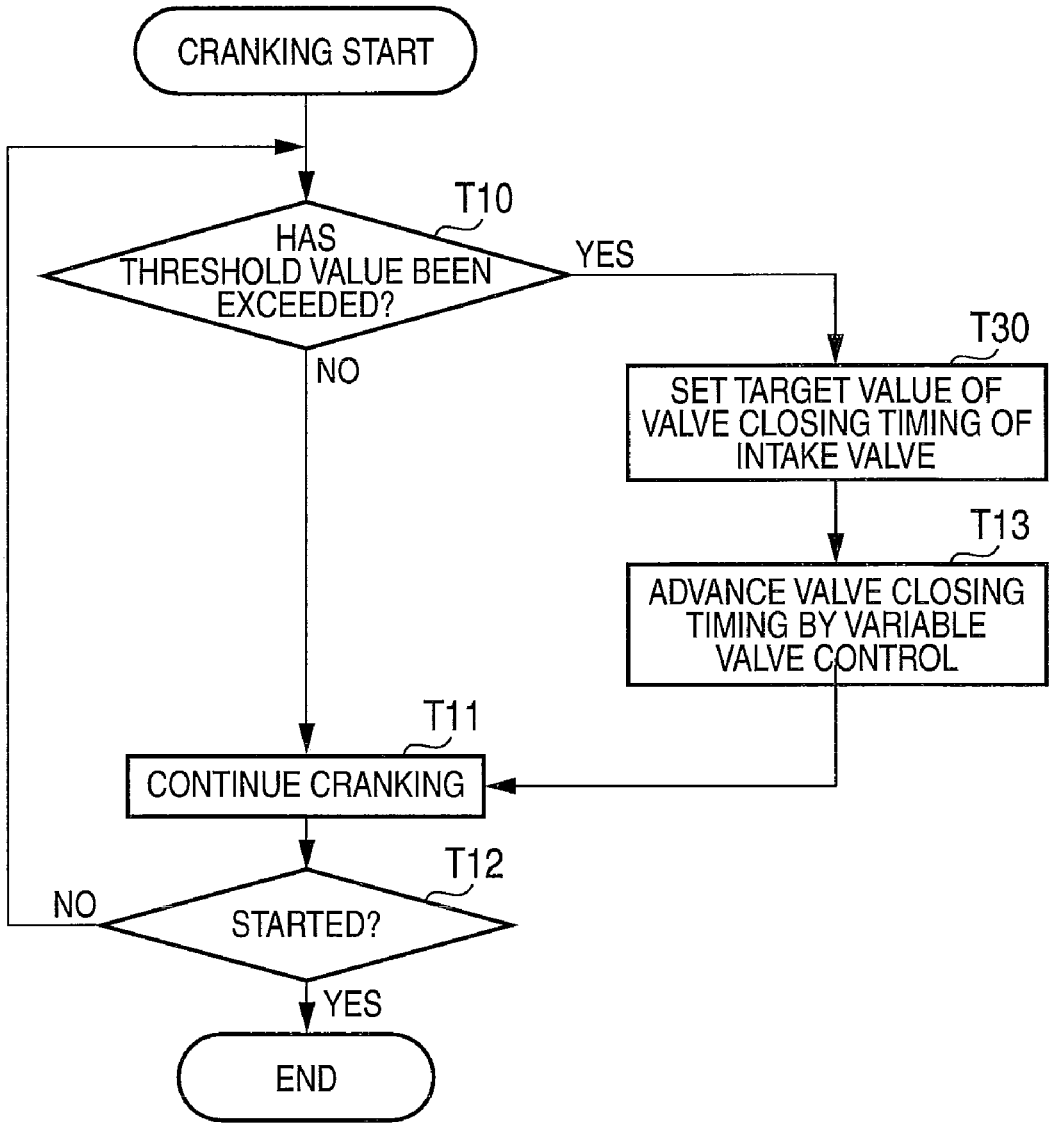
FIG. 13 is a flowchart describing control of a start control device as a part of a sixth embodiment of the present invention.

FIG. 13 shows a sixth embodiment of the present invention.

In the present embodiment, unlike the fourth embodiment in which a temporary closing timing for starting is set for stopping the engine, a temporary closing timing for starting is set during cranking for starting the engine.

In detail, Step T30 is provided between Step T10 and Step T13 of the flowchart of FIG. 11 of the fourth embodiment, and when the length of the cranking period exceeds the threshold value, a temporary closing timing for starting obtained according to the fuel properties detected at the previous time of engine driving is set as a target value. Then, the same valve closing timing for starting is set by the variable valve mechanism 25, and until the engine 1 starts, the valve closing timing of the intake valve 17 is advanced based on the set valve closing timing for starting.

In this case, the same effect as in the fourth embodiment is also brought about. Of course, this control can be combined with the technique for changing the degree of timing advance of the intake valve 17 as described in the fifth embodiment.

In the fourth embodiment, as a variable valve mechanism, a continuous phase variable valve mechanism which continuously changes the phase of the intake valve may also be used.

Further, in the fourth embodiment, as a variable valve mechanism, a continuous valve opening period variable valve mechanism which continuously changes the valve opening period of the intake valve 17 may also be used.

According to the embodiments described above, even if a fuel with fuel properties hard to ignite is used, even if the internal combustion engine is in a situation with ignition difficulty, and even if the properties of the fuel change, by advancing the valve closing timing of the intake valve during cranking, the internal combustion engine can be reliably started.

Further, the timing of the intake valve is advanced based on the valve closing timing for starting obtained from the fuel properties of the fuel, so that the cranking period can be prevented from being wastefully lengthened, and the engine can be quickly started in a short time.

Even if the internal combustion engine is in a state in which the components of the internal combustion engine are not sufficiently lubricated with a lubricant and the friction is great as in the cold state, the internal combustion engine can be smoothly started by using the variable valve mechanism.

Further, no matter what the fuel properties of the fuel in use are, and no matter how difficult to ignite in the use situation of the internal combustion engine, the internal combustion engine can be most quickly started.

The present invention is not limited to any of the embodiments described above, and may be variously changed without departing from the gist of the present invention. For example, in the above-described embodiments, to detect the fuel properties from existing components, fuel properties are detected from a change in ignition timing for driving the engine, however, without limiting to this, an exclusive fuel properties sensor such as a concentration sensor may be provided in the fuel tank to detect the fuel properties.

Further, in the above-described embodiments, an alcohol mixed fuel (mixed fuel) is used as one example of a fuel with different fuel properties, however, gasoline (light oil) different in octane number (cetane number) or volatility may also be used in the embodiments. Furthermore, a start control device 65 includes a motor generator in a case where an automobile (vehicle) to which the present invention is applied is a hybrid vehicle (gas-electric hybrid vehicle).

What is claimed is:

1. A start control device of an internal combustion engine, the start control device comprising:

a starting unit, which cranks the internal combustion engine to start the internal combustion engine while opening and closing an intake valve;

a variable valve mechanism, which can change a closing timing of the intake valve; and a control unit, which controls the variable valve mechanism so as to advance the closing timing of the intake valve while the starting unit cranks, wherein the closing timing of the intake valve is advanced in a phased manner in increments of an amount.

2. A start control device of an internal combustion engine, the start control device, comprising:

a starting unit, which cranks the internal combustion engine to start the internal combustion engine while opening and closing an intake valve;

a variable valve mechanism, which can change a closing timing of the intake valve; and a control unit, which controls the variable valve mechanism so as to advance the closing timing of the intake valve while the starting unit cranks, wherein the control unit sets a threshold value for determining whether the control unit controls the variable valve mechanism so as to advance the closing timing of the intake valve while the starting unit cranks, and when a length of a time period in which the starting unit cranks exceeds the threshold value, the control unit controls the variable valve mechanism so as to advance the closing timing of the intake valve.

3. The start control device according to claim 1, wherein the variable valve mechanism changes the closing timing of the intake valve while keeping an opening timing of the intake valve substantially constant.

4. A start control device of an internal combustion engine, the start control device, comprising:

a starting unit, which cranks the internal combustion engine to start the internal combustion engine while opening and closing an intake valve;

a variable valve mechanism, which can change a closing timing of the intake valve;

a control unit, which controls the variable valve mechanism so as to advance the closing timing of the intake valve while the starting unit cranks;

a detecting unit, which detects properties of a fuel to be used for the internal combustion engine; and a setting unit, which sets a temporary closing timing for starting, based on the properties of the fuel detected by the detecting unit, wherein the control unit controls the variable valve mechanism so as to advance the closing timing of the intake valve based on the temporary closing timing for starting while the starting unit cranks.

5. The start control device according to claim 4, wherein the detecting unit detects the properties of the fuel during driving of the internal combustion engine, the setting unit sets a temporary closing timing for starting, based on the properties of the fuel detected by the detecting unit, during driving of the internal combustion engine, the control unit controls the variable valve mechanism to change the closing timing of the intake valve to the temporary closing timing for starting, when the internal combustion engine is stopped, the control unit has a threshold value for determining whether the control unit controls the variable valve mechanism so as to advance the closing timing of the intake valve while the starting unit cranks, after the internal combustion engine is stopped, the closing timing of the intake valve is set to the temporary closing timing for starting and the closing timing of the intake valve is advanced from the temporary closing timing for starting when a length of a time period in which the starting unit cranks exceeds the threshold value.

6. The start control device according to claim 4, wherein the detecting unit detects the properties of the fuel during driving of the internal combustion engine, the setting unit sets a temporary closing timing for starting, based on the properties of the fuel detected by the detecting unit, during driving of the internal combustion engine, the control unit has a threshold value for determining whether the control unit controls the variable valve mechanism so as to advance the closing timing of the intake valve while the starting unit cranks, and when a length of a time period in which the starting unit cranks exceeds the threshold value, the closing timing of the intake valve is set to the temporary closing timing for starting and the closing timing of the intake valve is advanced from the temporary closing timing for starting.

7. The start control device according to claim 5, further comprising:

a situation detecting unit, which detects a situation of the internal combustion engine relating to ignition of the fuel, wherein the control unit changes degree of advance of the closing timing of the intake valve in accordance with the properties of the fuel and the situation of the internal combustion engine.

8. The start control device according to claim 6, further comprising:

a situation detecting unit, which detects a situation of the internal combustion engine relating to ignition of the fuel, wherein the control unit changes degree of advance of the closing timing of the intake valve in accordance with the properties of the fuel and the situation of the internal combustion engine.

* * * * *